US007476043B1

(12) United States Patent
Rivas

(10) Patent No.: US 7,476,043 B1
(45) Date of Patent: Jan. 13, 2009

(54) FINGERTIP WRITING INSTRUMENT

(76) Inventor: Angel Rivas, 15400 SW. 284th St., apt. 1203, Maimi, FL (US) 33033

( * ) Notice: Subject to any disclaimer, the term of this patent is extended or adjusted under 35 U.S.C. 154(b) by 0 days.

(21) Appl. No.: 11/927,986

(22) Filed: Oct. 30, 2007

(51) Int. Cl.
*A46B 5/04* (2006.01)
*B43K 29/00* (2006.01)

(52) U.S. Cl. ..... 401/7; 401/195

(58) Field of Classification Search ..... 401/6, 401/7, 8, 52, 195
See application file for complete search history.

(56) References Cited

U.S. PATENT DOCUMENTS

| | | | | | |
|---|---|---|---|---|---|
| 504,918 | A * | 9/1893 | Geissinger | 401/7 |
| 684,685 | A * | 10/1901 | Gerst | 401/7 |
| 2,151,846 | A * | 3/1939 | Greneker | 81/177.3 |
| 2,509,837 | A * | 5/1950 | Niizawa | 401/7 |
| 3,887,286 | A * | 6/1975 | Bucey | 401/7 |
| 5,405,203 | A | 4/1995 | Mizutani et al. | |
| 5,529,415 | A | 6/1996 | Bishop | |
| 6,161,974 | A | 12/2000 | Nakagawa | |
| 6,328,494 | B1 | 12/2001 | Moxon | |
| 6,527,464 | B2 | 3/2003 | Lee | |
| 6,591,456 | B2 | 7/2003 | DeLuca et al. | |
| 6,637,962 | B1 | 10/2003 | Roche et al. | |
| 6,648,537 | B1 | 11/2003 | Park | |
| 6,773,183 | B2 | 8/2004 | Geddes | |
| 6,905,271 | B1 | 6/2005 | Short | |
| 6,910,321 | B2 | 6/2005 | Hinds | |
| 6,913,406 | B1 | 7/2005 | Nocerino | |
| 7,037,017 | B2 * | 5/2006 | Buck et al. | 401/195 |
| 7,070,351 | B2 | 7/2006 | Cooper et al. | |

* cited by examiner

*Primary Examiner*—David J Walczak
(74) *Attorney, Agent, or Firm*—Michael I. Kroll

(57) ABSTRACT

A fingertip mountable writing instrument comprising a housing having an exterior wall and interior wall with a cavity therebetween forming an ink reservoir in fluid communication through an ink egress port with a ball point tip. The housing further has an elastomeric element positioned along the top rim for gripping a user's finger once inserted. Frictional elements on the exterior housing wall aid the user in turning pages without having to remove the fingertip pen.

6 Claims, 7 Drawing Sheets

FINGERTIP WRITING INSTRUMENT

BACKGROUND OF THE INVENTION

1. Field of the Invention

The present invention relates generally to writing instruments and, more specifically, to a fingertip mountable writing instrument. The fingertip writing instrument is comprised of a housing having an exterior wall and interior wall with a cavity therebetween forming an ink reservoir in fluid communication through an ink egress port with a ball point tip. The housing further comprises an elastomeric element positioned along the top of the housing for gripping a user's finger once inserted. Frictional elements are also provided on the exterior housing wall to aid the user in turning pages without having to remove the fingertip pen.

In addition, the present invention provides that the writing instrument may reduce stress on the fingers while writing, relieving the user of writer's cramp or arthritic pain. In addition users suffering from dystonia, tendonitis, repetitive stress injury, carpal tunnel syndrome and those with multiple sclerosis may also have the ability to write with a steadier, more comfortable hand. Furthermore, students may benefit from the ability to highlight text while reading and be able to thumb through a textbook using the frictional nubs positioned on the housing exterior.

Furthermore, the housing material can be constructed of a transparent or translucent material so that the user can view the remaining ink and can also be manufactured in various housing colors containing various ink colors.

2. Description of the Prior Art

There are other writing instruments designed for fingers. Typical of these is U.S. Pat. No. 5,405,203 issued to Mizutani et al. on Apr. 11, 1995.

Another patent was issued to Bishop on Jun. 25, 1996 as U.S. Pat. No. 5,529,415. Yet another U.S. Pat. No. 6,161,974 was issued to Nakagawa on Dec. 19, 2000 and still yet another was issued on Dec. 11, 2001 to Moxon as U.S. Pat. No. 6,328,494.

Another patent was issued to Lee on Mar. 4, 2003 as U.S. Pat. No. 6,527,464. Yet another U.S. Pat. No. 6,591,456 was issued to DeLuca, et al. on Jul. 15, 2003. Another was issued to Roche, et al. on Oct. 28, 2003 as U.S. Pat. No. 6,637,962 and still yet another was issued on Nov. 18, 2003 to Park as U.S. Pat. No. 6,648,537.

Another patent was issued to Geddes, et al. on Aug. 10, 2004 as U.S. Pat. No. 6,773,183. Yet another U.S. Pat. No. 6,905,271 was issued to Short on Jun. 14, 2005. Another patent was issued to Smith on Jun. 28, 2005 as U.S. Pat. No. 6,910,821. Another was issued to Nocerino on Jul. 5, 2005 as U.S. Pat. No. 6,913,406 and still yet another was issued on Jul. 4, 2006 to Cooper, et al. as U.S. Pat. No. 7,070,351.

U.S. Pat. No. 5,405,203

Inventors: Minoru Mizutani et al.

Issued: Apr. 11, 1995

A multicolor ink ribbon for use with a dot impact printer includes at least three layers. The layers include an ink layer composed of at least one colored ink ribbon having a first surface which forms a printing surface of the multicolor ink ribbon, an intermediate barrier layer having a first surface which covers a second surface of the ink layer, for preventing ink penetration from the ink layer therethrough, and a protective layer having a first surface which covers a second surface of the intermediate barrier layer and having a second surface which forms a printing head surface of the multicolor ribbon. The intermediate barrier layer prevents ink penetration from the ink layer into the protective layer, and the protective layer protects the intermediate barrier layer from physical deterioration due to impact from a printing head during use.

U.S. Pat. No. 5,529,415

Inventor: Deborah L. Bishop

Issued: Jun. 25, 1996

A fingertip pen writer comprised of a finger portion adapted for removable securement to a fingertip of a user. The finger portion has a holding chamber formed in an upper portion thereof. The finger portion has a ball point pen tip secured to an open end portion outwardly extending therefrom. An ink supply tube is secured within the holding chamber of the finger portion. The ink supply tube couples with the ball point pen tip of the finger portion for supplying ink to the ball point pen tip.

U.S. Pat. No. 6,161,974

Inventors: Satoshi Nakagawa

Issued: Dec. 19, 2000

A writing instrument comprises a gripping component formed in the shape of a tab. An insertion component is formed in an annular shape and provided to the lower surface of one end of the gripping component. A pen tip component is provided extending from one end of the gripping component and having at the distal end thereof a pen tip capable of writing.

U.S. Pat. No. 6,328,494

Inventor: William A. Moxon

Issued: Dec. 11, 2001

A tool holder or writing instrument is provided which includes a formable modeling compound material positioned around a flexible rod or tube which in a preferred embodiment is capable of holding an ink or other writing substance. The material is capable of conforming to the fingers and grip orientation of a user of the writing instrument to provide a comfortable, ergonomically correct writing instrument. Additionally, a portion of this writing instrument (e.g., the flexible tube) may be wrapped around at least one digit of the user's writing hand, e.g. the index finger, to provide additional support and comfort. One end of the tube can include means for removably attaching various hand tools such as scribes, knives, electrical contacts or the like.

U.S. Pat. No. 6,527,464

Inventor: Winston Delano Lee

Issued: Mar. 4, 2003

A multi-purpose fingertip pen/stylus comprising a flexible shaft having first and second ends made of a bendable material, which retains a twisted shape, said shaft sized of sufficient length to wrap and secure about the fingertip of a writing digit or to be used in a straightened position as a conventional pen; the first end adapted as a stylus tip for use with pressure sensitive computer screens, and the second end adapted as a writing tip to extend sufficiently beyond the fingertip of the writing digit stylus to contact and write on a writing surface.

U.S. Pat. No. 6,591,456

Inventors: Donald A. DeLuca et al.

Issued: Jul. 15, 2003

The present invention relates generally to a cushioning device that is adapted to retain a flowable medium to provide a cushioning effect. The cushioning device has a cushioning member having a deformable bladder member defining a medium chamber and a flowable medium, such as a fluid, retained in the chamber. The cushioning member is adapted to be mounted onto an article to thereby provide a cushioning effect for a user. The cushioning device can optionally have a support element to provide an additional cushioning effect. The present invention also relates to a cushioned article that has a finger-held or finger-manipulated article on which the cushioning device is mounted to provide a comfortable finger grip for a user. The cushioned article is so formed that it can fit within the user's finger grip and that the inflated bladder member can be deformed by the user's fingers or fingertips.

U.S. Pat. No. 6,637,962

Inventor: Colin Roche, et al.

Issued: Oct. 28, 2003

A writing instrument is comprised of an elongated body with a writing point at the lower end, and an upper end for supporting the base of the index finger. Arcuate arms extending up from the upper end of the body are arranged for being positioned on the sides of the index finger. A concave front groove is arranged along the front side of the body for cradling the tip of the index finger. Concave side grooves are arranged along the sides of the body for cradling the tips of the thumb and middle finger. Forwardly protruding ears are arranged between the front and respective sides for being pinched between the index finger and the thumb, and between the index finger and the middle finger. A knob on the rear of the body is movable for retracting or extending a cap to expose or cover the writing point.

U.S. Pat. No. 6,648,537

Inventor: Jun-Hyoung Park

Issued: Nov. 18, 2003

Disclosed is a finger insertion type writing device that is capable of being used for writing something down in the state of being fixed by a user's index finger, while it is not held by the user's other fingers, whereby he or she can continue to write down for a relatively long period of time, with no fatigue and even in the case that he or she doesn't write it down, he or she can use his or her fingers freely to thereby carry out any work using his or her fingers. As shown in FIG. 1, the finger insertion type writing device includes a main body (10), a support part (20) coupled to the main body (10) and a finger insertion part (30), said main body (11) taking a hollow shape with symmetrical pattern wherein a writing means (11) is inserted into internal hollow, said support part (20) coupled to said main body (10) is formed with a symmetrically curved part supporting said writing device by contacting one side of inserted finger in the finger insertion part (30), said finger insertion part (30) taking a hollow shape with the front side and the rear side opened, said finger insertion part comprising a hollow part serving as a finger insertion cavity, a symmetrically incised part formed on the one side thereof, on opposite side part to said symmetrically incised part (32) coupled to said main body.

U.S. Pat. No. 6,773,183

Inventor: William Thomas Geddes

Issued: Aug. 10, 2004

A unique writing instrument. Preferred is a bow shaped barrel with an arched and hinged or flexible upper member and a rigid lower member. A method of producing the writing instrument is also described.

U.S. Pat. No. 6,905,271

Inventor: Ronald J. Short

Issued: Jun. 14, 2005

A finger-mounted marking device allowing marking instruments such as a pen or pencil to be worn on a finger, and allowing for hands-free usage without engaging other fingers two rings are coupled to the cylinder for receiving the operator's finger. A cylinder holds a marking instrument, and a set screw holds the marking instrument in place. The marking instrument can be adjusted or replaced based on the desires of the operator. In a second embodiment, a strap is coupled to the cylinder through a strap receiving holder and receives the operator's finger. A latch holds the marking instrument in place by applying pressure and allows the marking instrument to be adjusted or replaced.

U.S. Pat. No. 6,910,321

Inventor: Otis Smith

Issued: Jun. 28, 2005

A ring pen device convertible between a use as a finger ring and a writing implement includes: (a) a ring hull; (b) a hull insert that is insertable within the ring hull, the hull insert including a channel; and (c) an extendible pen assembly in the hull insert, the pen assembly including at least one marking tube; wherein the pen assembly has a retracted position within the hull insert, and an extended position in which a portion of the marking tube extends from an end of the channel in the hull insert. The pen assembly preferably includes a slide bar with at least one pair of matching stops extending from it, and at least one marking tube adjacent the slide bar, each slide bar stop being removably engageable with at least one of the notches.

U.S. Pat. No. 6,913,406

Inventor: Gina A. Nocerino

Issued: Jul. 5, 2005

A writing instrument is comprised of an elongated, hollowed body that is cylindrical in shape, which extends and narrows into a tip for writing. Implement is worn directly upon a single finger by insertion through an opening at the upper or rear end of said body, and is constructed of durable yet flexible material. Writing implement also has an adjustable closure attached to its exterior, which extends laterally across body for a tighter or looser fit. The body is worn and extends approximately from knuckle to just past tip of finger. Toward lower end of said body, writing implement narrows past tip of finger and changes form into a harder material, the barrel, which begins the housing of a plastic, internal, ink tube or cartridge. The barrel attaches to and detaches from and equally hard and increasingly narrowing tip, through which the ink tube continues to extend internally. Finally the pointed, lower most end of said writing implement, is the tip from which the ink cartridge protrudes and permits writing. Movement of and exertion from finger inside this writing instrument allows for writing or drawing independent from gripping and the use of other fingers.

U.S. Pat. No. 7,070,351

Inventors: Kenneth R Cooper et al.

Issued: Jul. 4, 2006

A gripping element, particularly to writing instruments having a gripping element, which more specifically relates to a marker having a gripping element over a central region thereof. Such positioning of the gripping element facilitates use of the writing instrument in other than standard writing grasps. For example, the positioning of a gripping element over the central region of a writing instrument facilitates gripping of the writing instrument when writing on vertical or inverse horizontal (i.e. upside down) planes. The gripping element has a plurality of elevated sections in the form of intercalated crosses and hexagons or sliced hexagons. The elevated sections may be smooth or textured to enhance gripping and to reduce slippage of the writing instrument during use.

While these writing instruments may be suitable for the purposes for which they were designed, they would not be as suitable for the purposes of the present invention, as hereinafter described.

SUMMARY OF THE PRESENT INVENTION

A primary object of the present invention is to provide a fingertip mountable writing instrument.

Another object of the present invention is to provide a fingertip writing instrument having a housing comprising an exterior wall and interior wall with a cavity therebetween.

Yet another object of the present invention is to provide a fingertip writing instrument wherein said cavity forms an ink reservoir.

Still yet another object of the present invention is to provide a fingertip writing instrument wherein said ink reservoir is in fluid communication with a ball point tip through an ink egress port.

Another object of the present invention is to provide a fingertip writing instrument wherein said housing further provides an elastomeric element positioned along the top of the housing for gripping a user's finger once inserted.

Yet another object of the present invention is to provide a fingertip writing instrument having exterior housing frictional elements to aid the user in turning pages without having to remove the fingertip pen.

Still yet another object of the present invention is to provide a fingertip writing instrument wherein said housing material is constructed of a transparent or translucent material so that the user can view the remaining ink.

Another object of the present invention is to provide a fingertip writing instrument that can also be manufactured in various housing colors containing various ink colors.

An additional object of the present invention is to provide a fingertip writing instrument that may reduce stress on the fingers while writing, relieving the user of writer's cramp or arthritic pain and those users suffering from dystonia, tendonitis, repetitive stress injury, carpal tunnel syndrome and those with multiple sclerosis may also have the ability to write with a steadier, more comfortable hand.

Another object of the present invention is to provide a fingertip writing instrument where students may benefit from the ability to highlight text while reading and be able to thumb through a textbook using the frictional nubs positioned on the housing exterior.

Additional objects of the present invention will appear as the description proceeds.

The present invention overcomes the shortcomings of the prior art by providing a fingertip mountable writing instrument comprising a housing having an exterior wall and interior wall with a cavity therebetween forming an ink reservoir in fluid communication through an ink egress port with a ball point tip. The housing further has an elastomeric element positioned along the top rim for gripping a user's finger once inserted. Frictional elements on the exterior housing wall aid the user in turning pages without having to remove the fingertip pen. The housing material can be constructed of a transparent or translucent material so that the user can view the remaining ink and can also be manufactured in various housing colors containing various ink colors. In addition, the writing instrument may reduce stress on the fingers while writing, relieving the user of writer's cramp or arthritic pain and those users suffering from dystonia, tendonitis, repetitive stress injury, carpal tunnel syndrome and multiple sclerosis may also have the ability to write with a steadier, more comfortable hand. While students may benefit from the ability to highlight text while reading and be able to thumb through a textbook using the frictional nubs positioned on the housing exterior.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
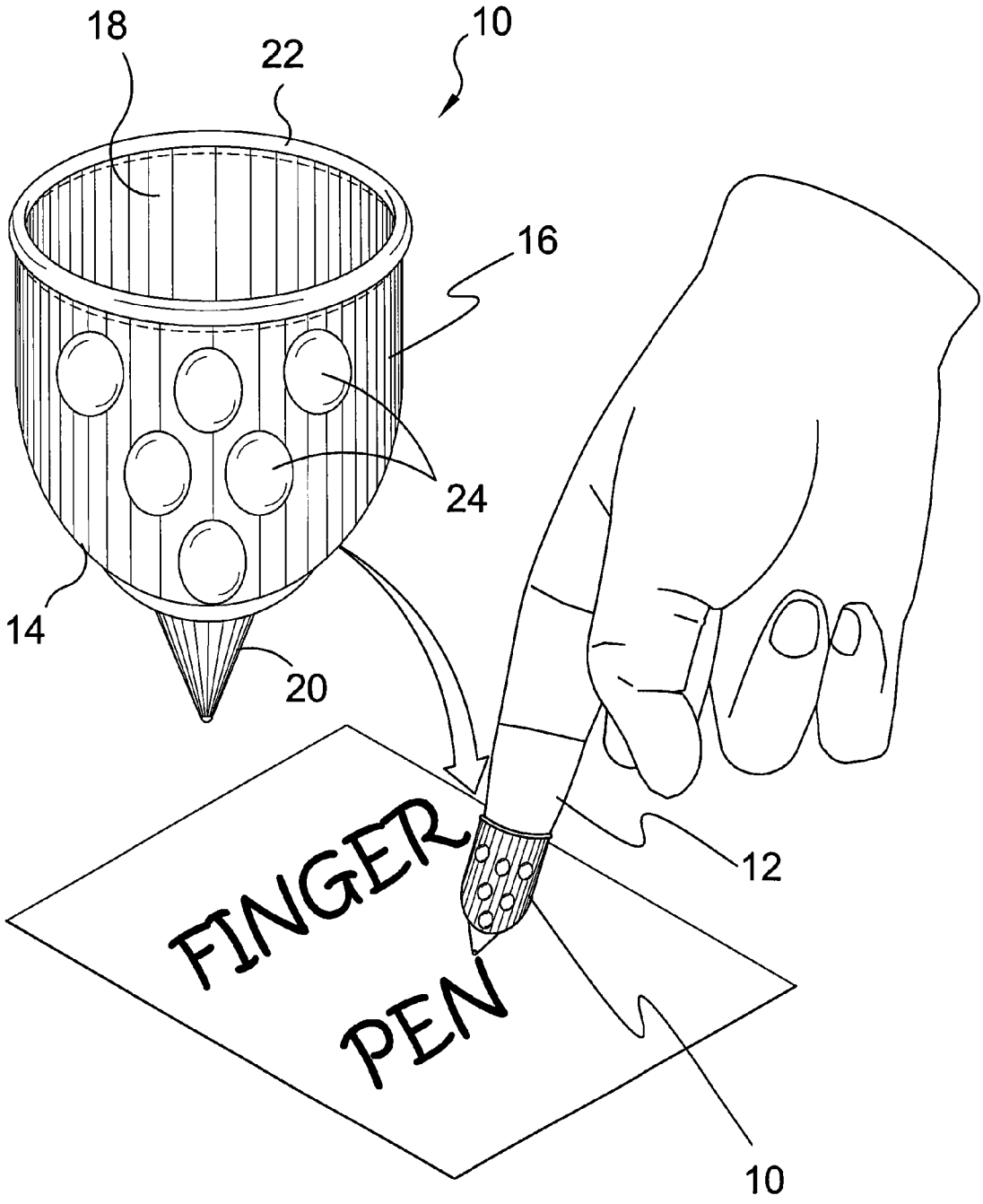
FIG. 1 is an illustrative view of the fingertip pen of the present invention in use.

Turning now descriptively to the drawings, in which similar reference characters denote similar elements throughout the several views, the figures illustrate the Fingertip Mountable Pen of the present invention. With regard to the reference numerals used, the following numbering is used throughout the various drawing figures.

10 Fingertip Mountable Pen of the present invention
12 finger of user
14 housing
16 exterior wall of 14
18 interior wall of 14
22 elastomeric element
24 frictional element
26 fingertip aperture of 14
28 ink reservoir
30 ink egress port
32 ink

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the fingertip pen of the present invention 10 in use. The present invention is a writing instrument mountable to a fingertip 12. The fingertip writing instrument 10 comprises a housing 14 having an exterior wall 16 and interior wall 18 with a cavity therebetween forming an ink reservoir in fluid communication through an ink egress port with a ball point tip 20. The housing 14 further comprises an elastomeric element 22 positioned along the top of the housing 14 for gripping a user's finger 12 once inserted. Also shown are frictional elements 24 positioned on the exterior housing wall 16 to aid the user in turning pages without having to remove the fingertip pen 10. Preferably the fingertip pen 10 is constructed of a transparent or translucent material so that the user can see the amount of ink therein.

Figure 2:
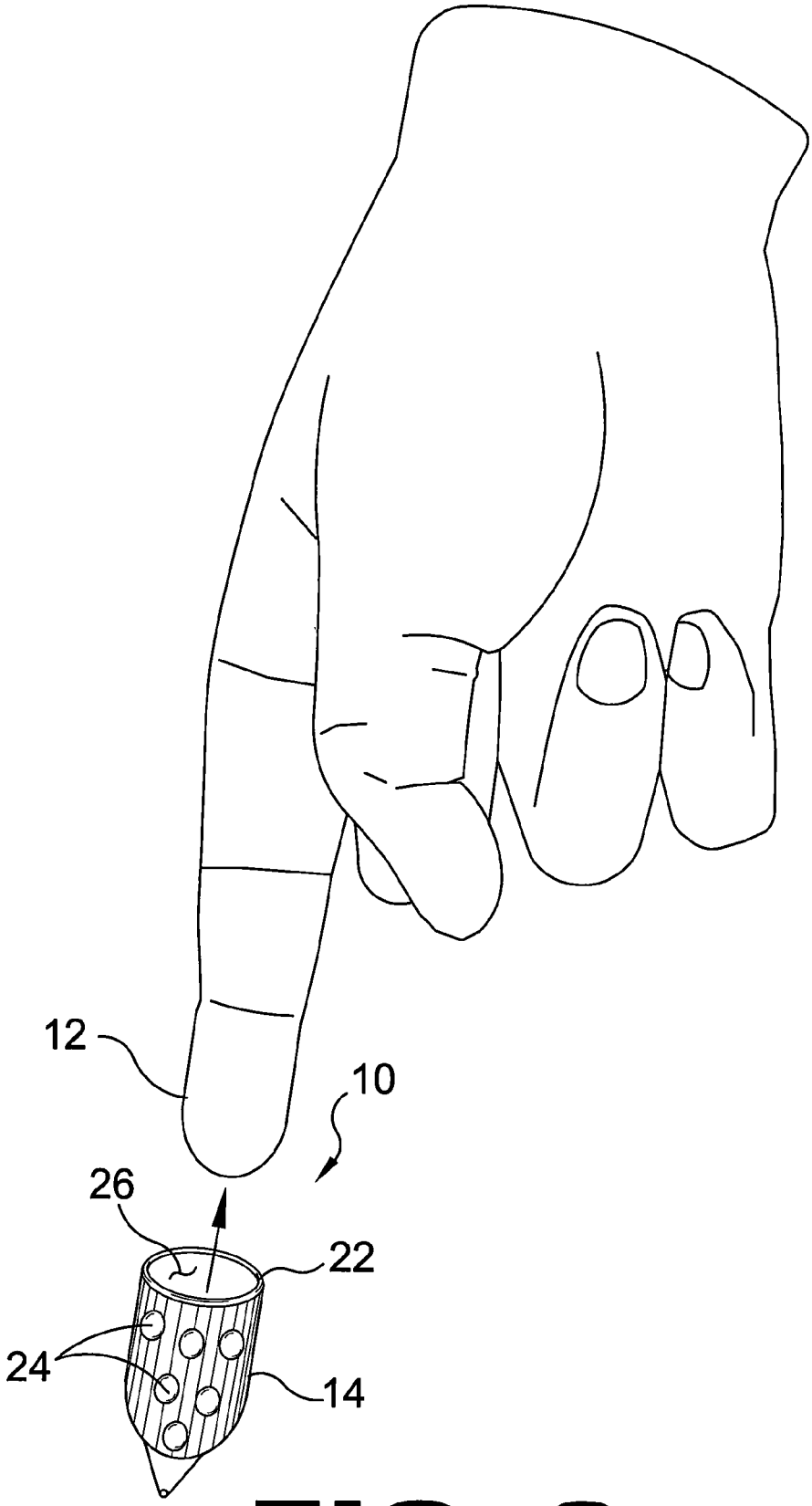
FIG. 2 is an illustrative view of the fingertip pen about to be mounted on an index finger.

FIG. 2 is an illustrative view of the fingertip pen 10 about to be mounted on an index finger 12. The fingertip writing instrument 10 is mountable to a user selected fingertip 12 and is held thereon by an elastomeric band 22 formed along the rim of the fingertip aperture 26 of the housing 14. The housing 14 is preferably constructed of a transparent or translucent material whereby the amount of ink remaining is viewable through the housing material. In addition to being able to write with the pen, the present invention provides a plurality of frictional nub elements 24 positioned on the exterior surface to aid the user in turning pages without removing the pen.

Figure 3:
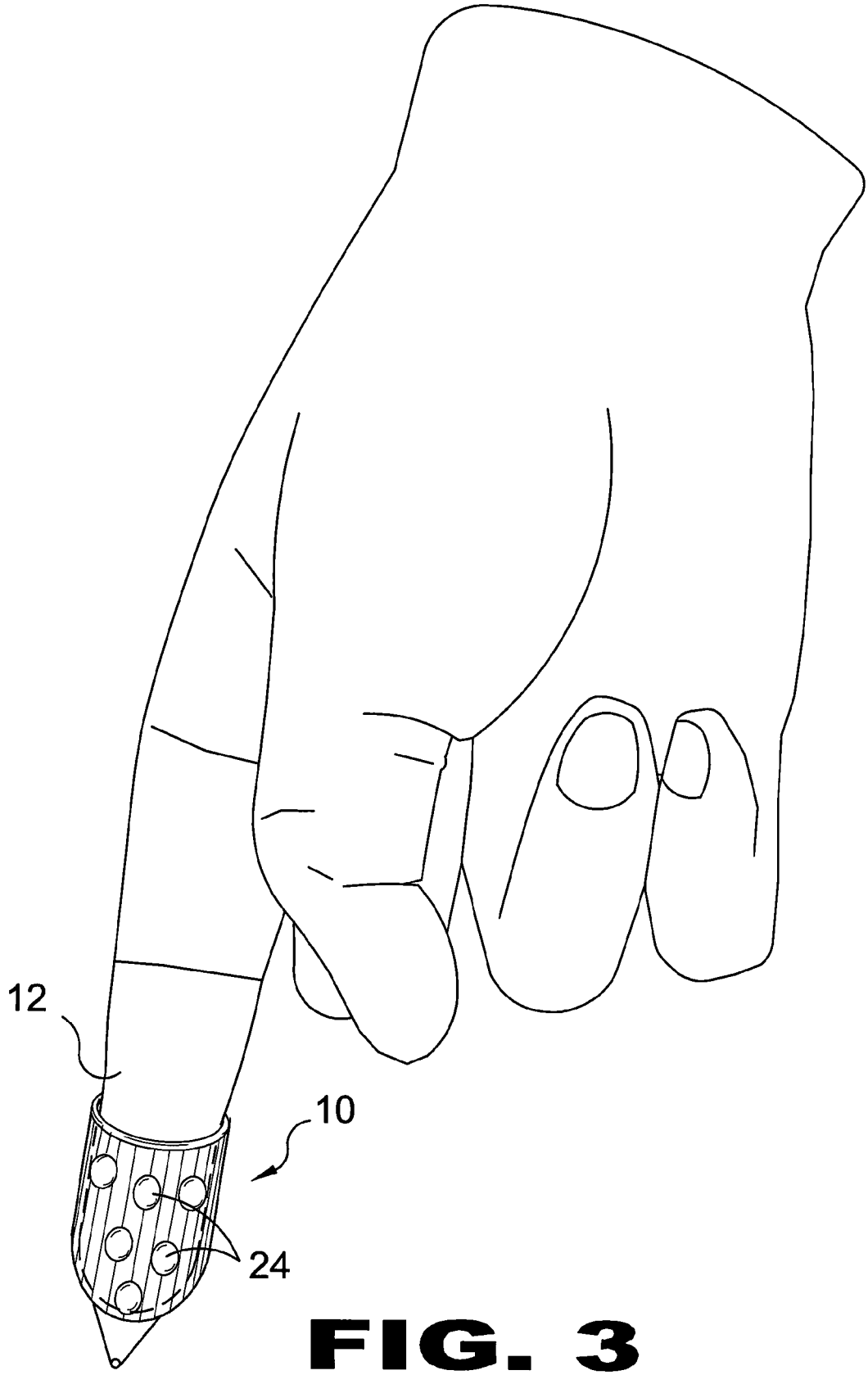
FIG. 3 is an illustrative view of the present invention mounted on a user's index finger.

FIG. 3 is an illustrative view of the present invention 10 mounted on a user's index finger 12. Depicted is the fingertip pen 10 mounted on an index FIG. 12 for enablement purposes but may just as well be mounted to any finger 12 as desired by the user. The present invention 10 provides that the writing instrument may reduce stress on the fingers while writing, relieving the user of writer's cramp or arthritic pain. In addition users suffering from dystonia, tendonitis, repetitive stress injury, carpal tunnel syndrome and those with multiple sclerosis may also have the ability to write with a steadier, more comfortable hand. Furthermore, students may benefit from the ability to highlight text while reading and be able to thumb through a textbook using the frictional nubs 24 positioned on the housing exterior.

Figure 4:
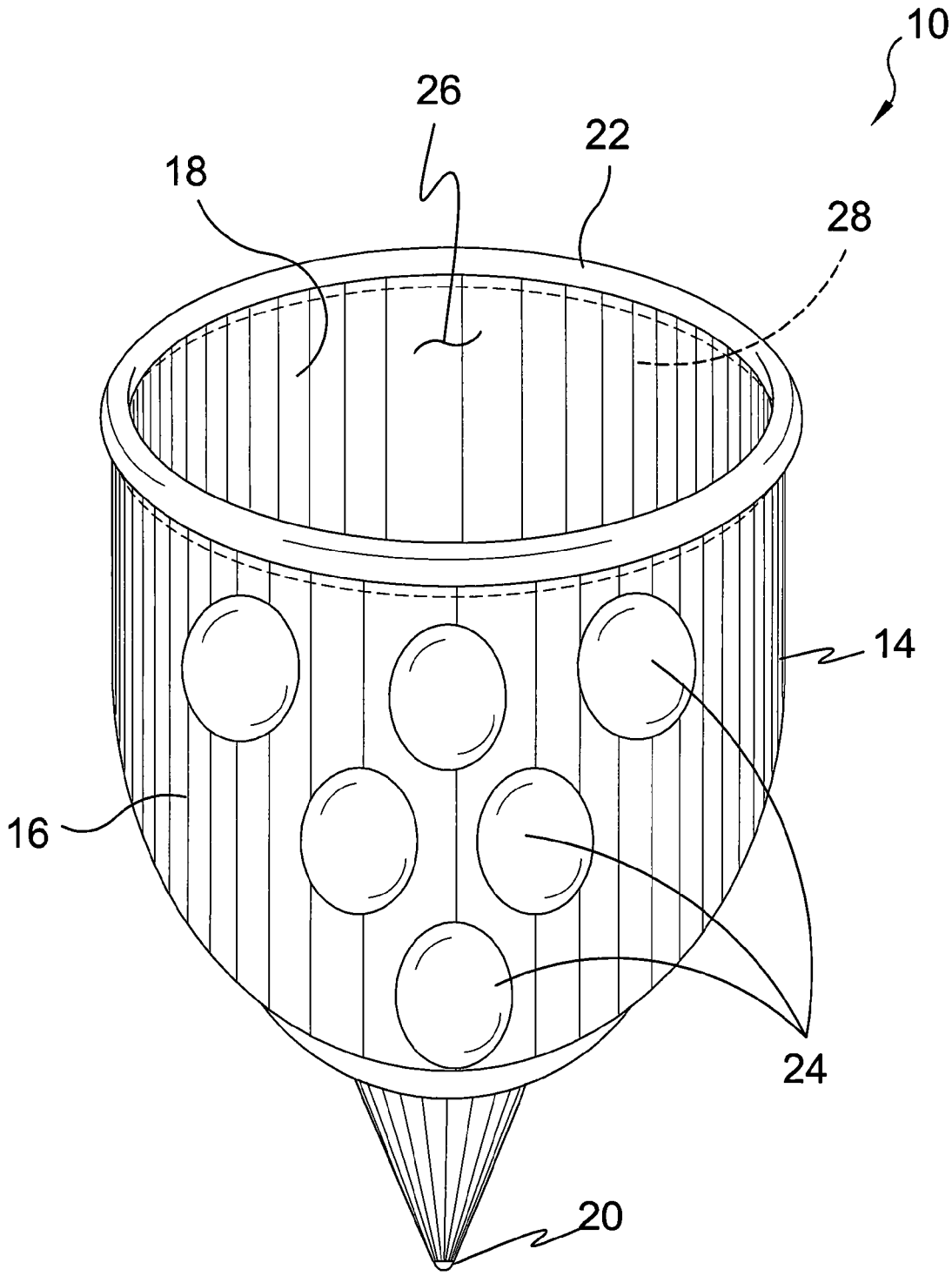
FIG. 4 is a perspective view of the fingertip pen of the present invention.

FIG. 4 is a perspective view of the fingertip pen of the present invention 10. The fingertip writing instrument 10 is comprised of a housing 14 having an exterior wall 16 and interior wall 18 with a cavity therebetween forming an ink reservoir 28 in fluid communication through an ink egress port with a ball point tip 20. The housing further comprises an elastomeric element 22 positioned along the top of the housing 14 for gripping a user's finger once inserted into the finger aperture 26. Frictional elements 24 positioned on the outer exterior housing wall 16 aid the user in turning pages without having to remove the fingertip pen 10. The fingertip pen 10 is constructed of a transparent or translucent material whereby the user can see the remaining contents therein.

Figure 5:
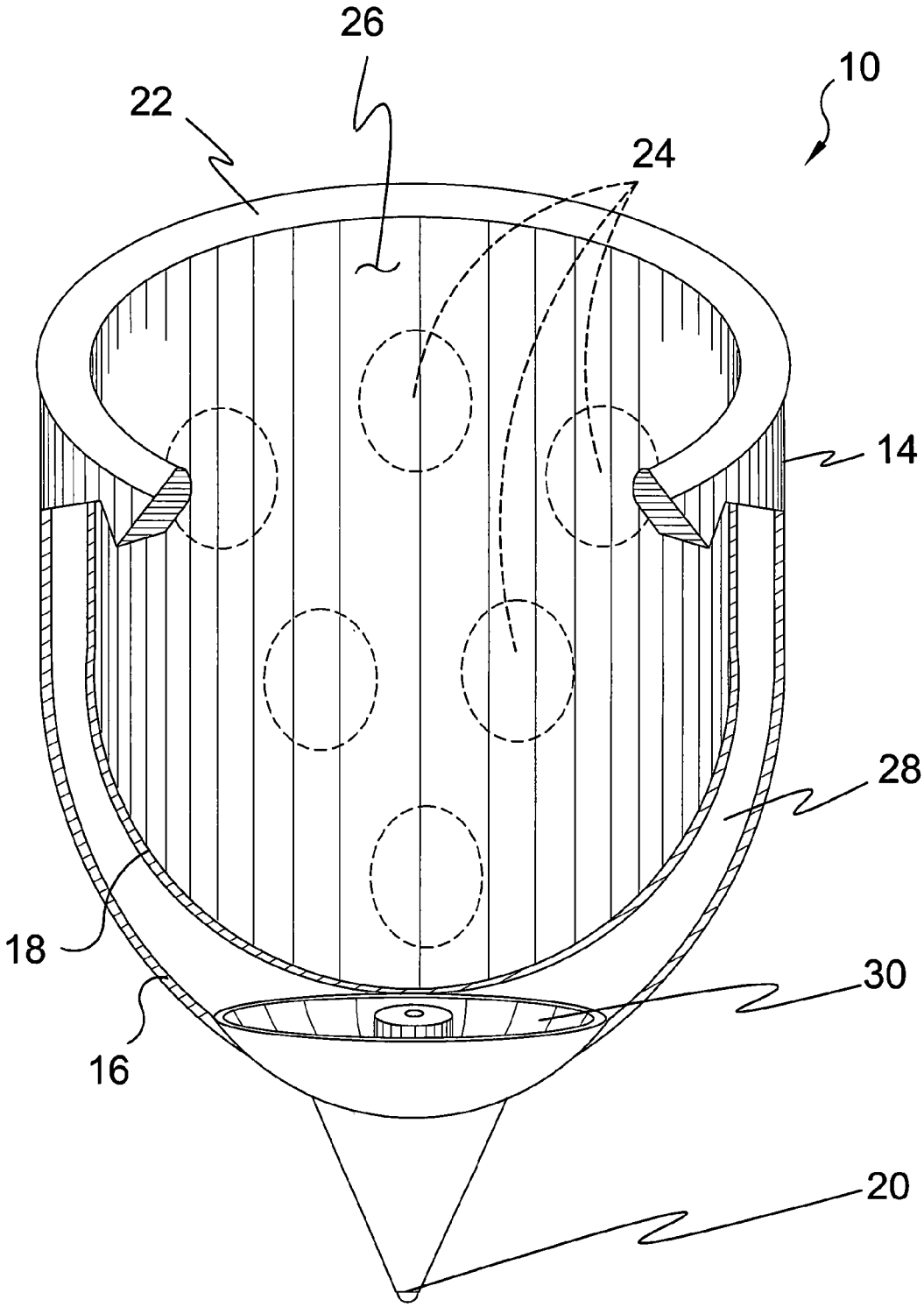
FIG. 5 is a cutaway view of the fingertip pen.

FIG. 5 is a cutaway view of the fingertip pen 10. Preferably constructed of a transparent or translucent material so that the user can view the remaining ink, the fingertip pen can also be manufactured in various housing 14 colors and various ink colors. The pen 10 provides a centrally disposed aperture 26 rimmed by an elastomeric band 22 to hold the pen 10 to a user's fingertip. Also provided on the exterior surface is a plurality of frictional nubs 24 to aid in turning pages. The housing 14 further provides an interior wall 18 and an exterior wall 16 with an ink reservoir 28 formed therebetween in fluid communication with a pen tip 20 through an ink egress port 30.

As illustrated in FIG. 5, housing 14 is cup-like in shape and has a substantially closed bottom formed by interior and exterior walls 18 and 16, respectively, and circular frictional nub elements 24 described above.

Figure 6:
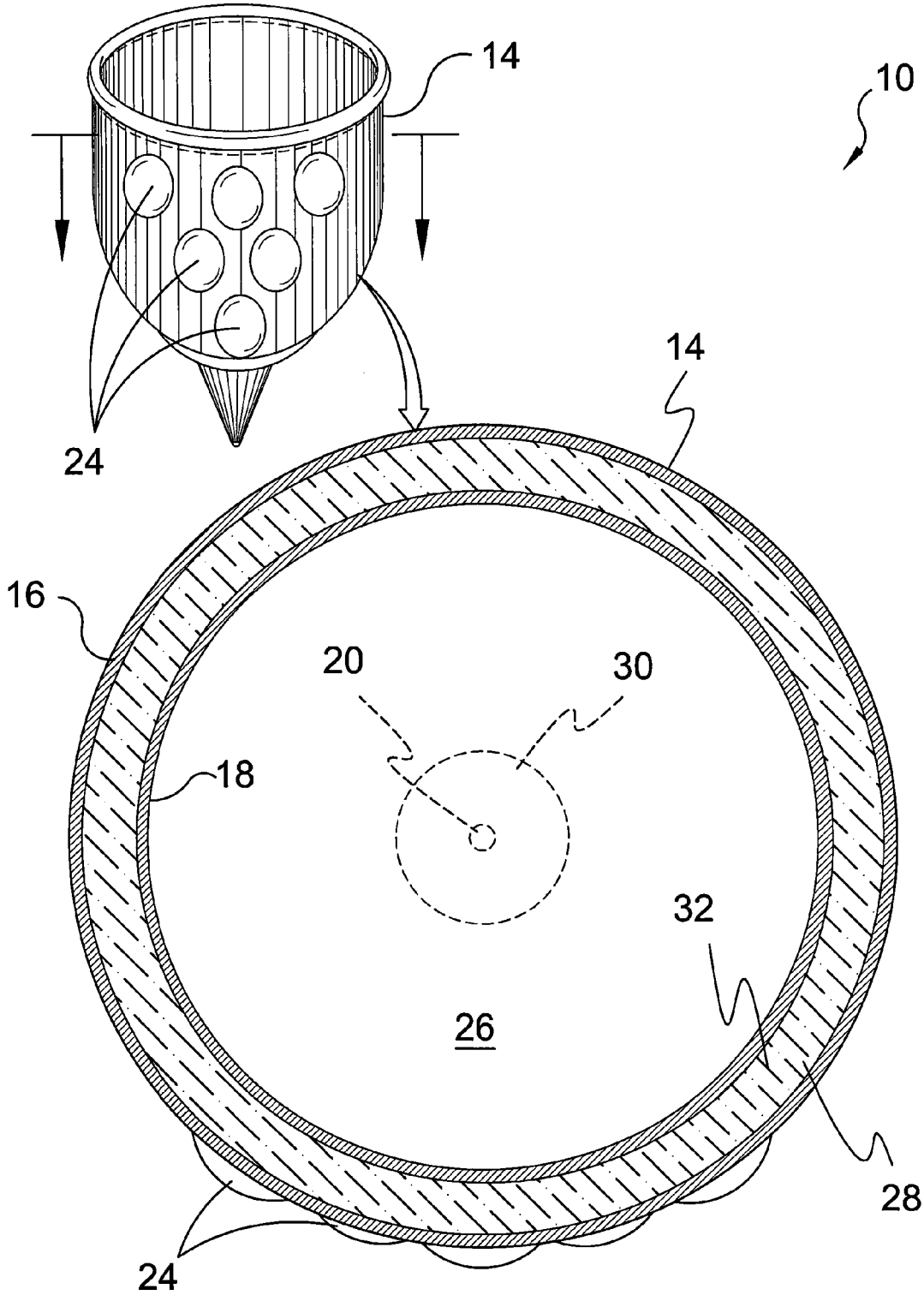
FIG. 6 is a cutaway view of the fingertip pen of the present invention.

FIG. 6 is a cutaway view of the fingertip pen of the present invention 10. Illustrated is a cutaway view of the fingertip pen 10 showing the finger aperture 26 and ink 32 within an ink reservoir 28 positioned between an interior wall 18 and an exterior wall 16 of the housing 14 having an ink egress port 30 in liquid communication with a ball point tip 20. Also shown are exteriorly positioned nubs forming frictional elements 24 to aid the user in turning pages. The exterior wall 16 is manufactured of a transparent or translucent material whereby the user can view the remaining ink 32.

Figure 7:
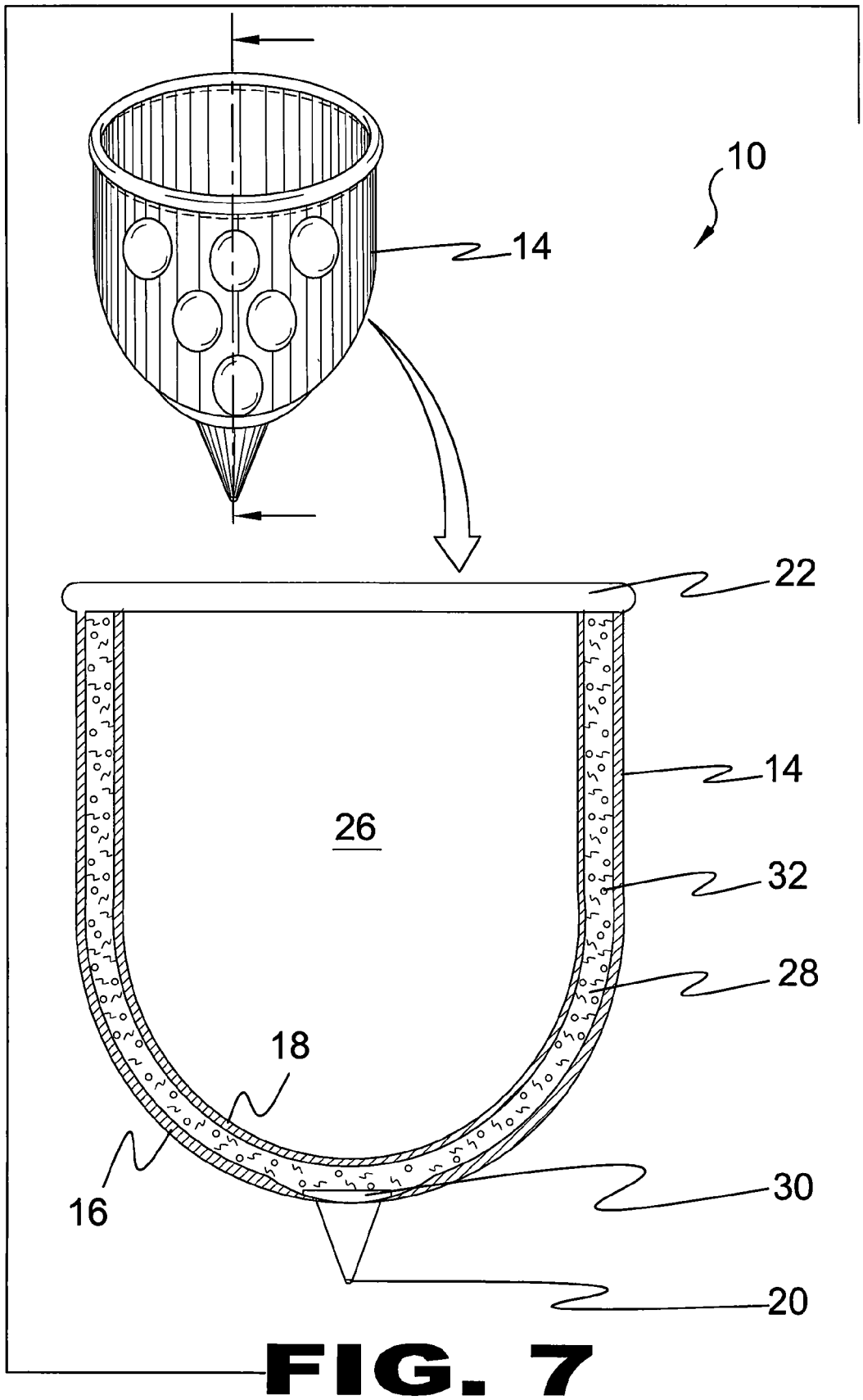
FIG. 7 is a sectional view of the present invention.

FIG. 7 is a sectional view of the present invention 10. Shown is the fingertip pen 10 comprising a housing 14 having an interior wall 18 and an exterior wall 16 with a cavity therebetween forming an ink reservoir 28 in fluid communication with a pen tip 20 through an ink egress port 30. The housing 14 is further provided with an elastomeric member 22 positioned along the fingertip aperture 26 rim to secure the pen 10 to the user's finger. The housing 14 material can be constructed of a transparent or translucent material so that the user can view the remaining ink and can also be manufactured in various housing colors containing various ink colors.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A fingertip mountable writing instrument comprising:

a) a cup-like housing having an exterior wall and an interior wall adapted to mounted on a fingertip;

b) an opening into said housing substantially sized to receive said fingertip;

c) said interior and external walls being spaced and forming a reservoir therebetween storing ink;

d) means for dispensing said ink from a closed end of said housing comprising an ink egress port in said closed end of said housing in liquid communication with said ink reservoir and a ball point tip that distributes said ink to an applied surface when in contact therewith;

e) a circular band of elastomeric material lining said opening for securing said housing to said fingertip, and a plurality of circular frictional nub elements protruding from an exterior portion of said housing to enable a user to use said writing instrument to easily turn pages without having to remove said writing instrument.

2. The fingertip mountable writing instrument recited in claim 1, wherein said exterior wall of said housing is translucent or transparent to enable the user to view the quantity of ink remaining in said reservoir.

3. The fingertip mountable writing instrument recited in claim 1, wherein said ink is provided in a plurality of colors thereby enabling the user to change colors simply by changing writing instruments.

4. The fingertip mountable writing instrument recited in claim 3, wherein said housing is the same color as the ink contained therein to provide a visual indicator thereof.

5. A fingertip writing instrument comprising:

a) a housing having a substantially closed bottom with spaced apart interior and exterior sidewalls depending therefrom and an open top adapted to be mounted on a fingertip of a user;

b) a reservoir defined by a cavity formed between said spaced apart interior and exterior sidewalls and storing ink therein;

c) an ink egress port disposed on the closed bottom of said housing in liquid communication with said ink in said reservoir;

d) a ball point tip in liquid communication with said ink egress port and projecting from the bottom of said housing for distributing said ink during use;

e) an elastomeric band encircling a rim of said open top for securing said housing to said fingertip; and f) a plurality of circular frictional elements protruding from said housing to enable the user to use said writing instrument while mounted on said fingertip to easily grasp and handle paper.

6. The fingertip writing instrument recited in claim 5, wherein said exterior wall of said housing is translucent or transparent to enable the user to take account of the quantity of ink remaining in said reservoir.

* * * * *